US005506413A

United States Patent [19]

Enloe

[11] Patent Number: 5,506,413

[45] Date of Patent: Apr. 9, 1996

[54] SPATIAL-FOCUS ENERGY ANALYZER

[75] Inventor: Carl L. Enloe, Colorado Springs, Colo.

[73] Assignee: The United States of America as represented by the Secretary of the Air Force, Washington, D.C.

[21] Appl. No.: 275,691

[22] Filed: Jul. 8, 1994

[51] Int. Cl.[6] ..... H01J 47/00

[52] U.S. Cl. ..... 250/305

[58] Field of Search ..... 250/305

[56] References Cited

U.S. PATENT DOCUMENTS

| | | | |
|---|---|---|---|
| 4,126,781 | 11/1978 | Siegel | 250/305 |
| 4,184,073 | 1/1980 | Gilbert | 250/305 |
| 4,205,226 | 5/1980 | Gerlach | 250/305 |
| 4,320,298 | 3/1982 | Buford, Jr. et al. | 250/358 R |
| 4,959,544 | 9/1990 | Sukenobu | 250/305 |
| 4,961,880 | 10/1990 | Barker | 252/626 |
| 5,041,760 | 8/1991 | Koloc | 315/111.41 |
| 5,076,971 | 12/1991 | Barker | 252/626 |
| 5,285,066 | 2/1994 | Sekine et al. | 250/305 |
| 5,357,107 | 10/1994 | Ibach et al. | 250/305 |

*Primary Examiner*—Bruce C. Anderson
*Attorney, Agent, or Firm*—William G. Auton

[57] ABSTRACT

The spatial-focus energy analyzer consists of an aperture plate (a) in the shape of a wedge, with the actual aperture at the apex of the wedge, an analyzing region (b) in the shape of a rectangular box with a hole in one end through which the aperture plate protrudes and a wide slit at the other end, an image plane (c) with a thin slit in it, and a particle detector (d). The preferable particle detector is a microchannel plate with a segmented anode, although a simple conducting plate (segmented or not) may be used connected to one or more analog current meters if the particle flux is large enough. In operation, the device is aligned to that the flux of particles to be analyzed enter the entrance aperture. The particle flux or current is measured as a varying voltage is applied to the analyzing structure. Particles with a given energy will have trajectories within the analyzing region will be focused on the slit in the image plane. Particles with different energies will be defocused and hence unable to pass through the slit and onto the active areas of the particle detector. Because of the particular trajectory that the particles take, the position of the particle on the active are of the particle detector is uniquely related to the angle of incidence of the particle as it enters the device.

4 Claims, 3 Drawing Sheets

SPATIAL-FOCUS ENERGY ANALYZER

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to energy measurement and more specifically the invention pertains to a type of electrostatic energy analyzer for charged particles (electrons and ions).

The simplest device for analyzing the energies of a group of charged particles is the planar retarding potential analyzer (RPA), consisting of an electrically biased screen placed between two electrically biased screens. Although simple, such an analyzer suffers from the drawback that it accurately determines the energies of particles only if they are moving along a line perpendicular to the grids. If the particles enter off-axis, errors are introduced into the measurement. In practical terms, to get good energy resolution from a planar RPA, it is necessary to use fine mesh screens, which limits the amount that the size of the analyzer can be reduced.

SUMMARY OF THE INVENTION

The spatial-focus energy analyzer is a type of electrostatic energy analyzer for charged particles (electrons and ions). It includes an electrically grounded front aperture plate in the shape of a wedge with the entrance aperture at the apex of the wedge, an electrically biased analyzing structure in the shape of a box with a hole in one end through which the front aperture plate protrudes and a wide slit across the opposite end, an electrically grounded image plane with a thin slit in it, and a particle detector. The device determines the energies of incident charged particles by passing or rejecting particles as a function of the bias potential applied to the analyzing structure.

In the system described above, the electrically biased analyzing structure serves as a means for spreading out the trajectories of charged particles into a trajectory pattern so that only charged particles of interest are pass through the slit in the electrically grounded image plane. More specifically, this structure is a boxed waveguide which has a charge supplied to its surface by a variable voltage source, which produces an electromagnetic field in the interior of the structure. Charged particles that encounter this electromagnetic field are diffracted in proportion to the charge they possess. By adjusting the location and size of the slit at the exit area of the analyzing structure, the user can selectively measure charged particles of interest.

It is an object of the present invention to measure the energies of charged particles with a high degree of accuracy. It is another object of the invention to aid in this analysis of the charged particle environment in the vicinity of a spacecraft and control of plasma processing application.

These objects together with other objects, features and advantages of the invention will become more readily apparent from the following detailed description when taken in conjunction with the accompanying drawings wherein like elements are given like references numerals throughout.

DETAILED DESCRIPTION OF THE PREFERRED EMBODIMENT

Figure 1:
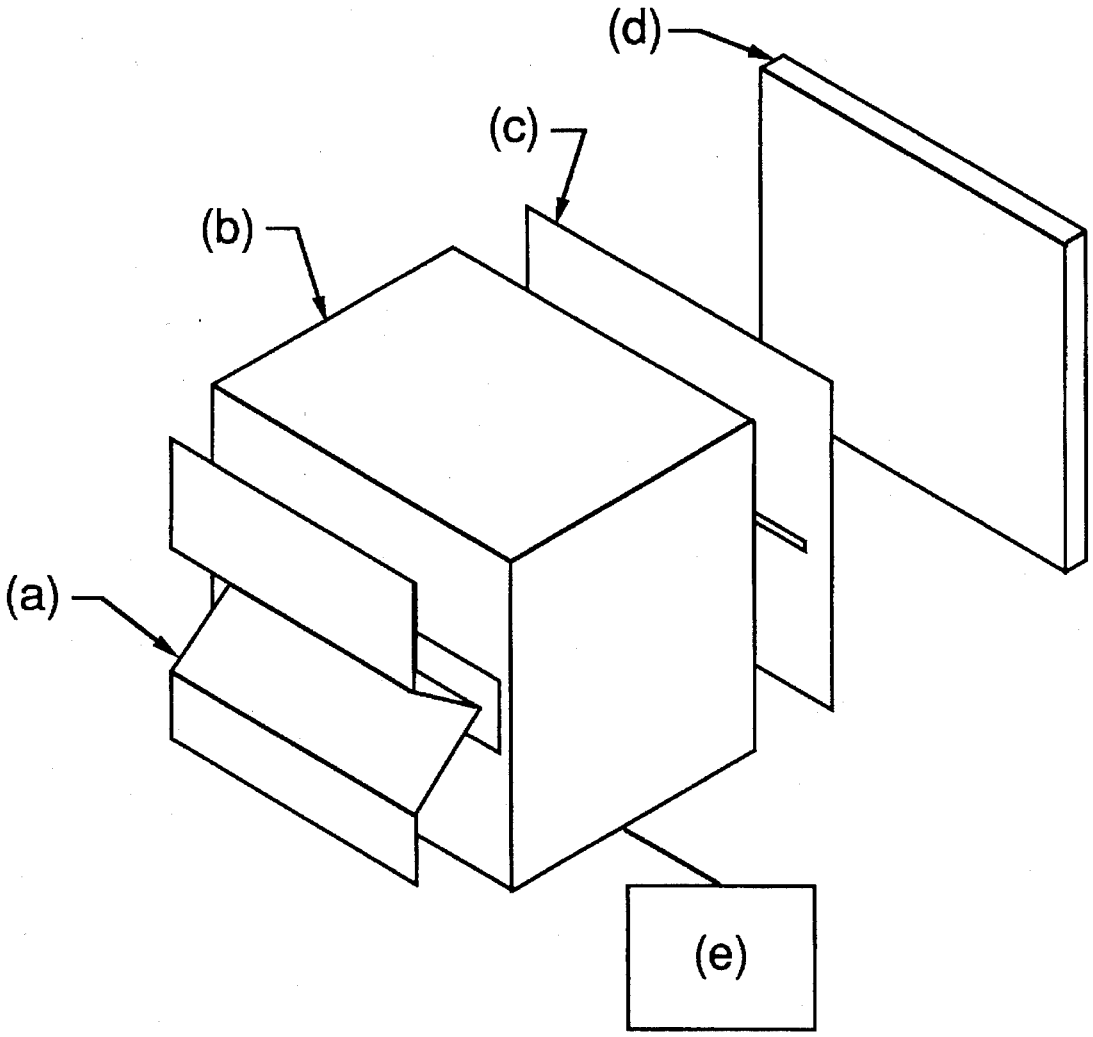
FIG. 1 is an illustration of an embodiment of the invention consisting of a) grounded entrance aperture wedge, b) biased retarding structure, c) an image plane and d) particle detector.
Figure 2:
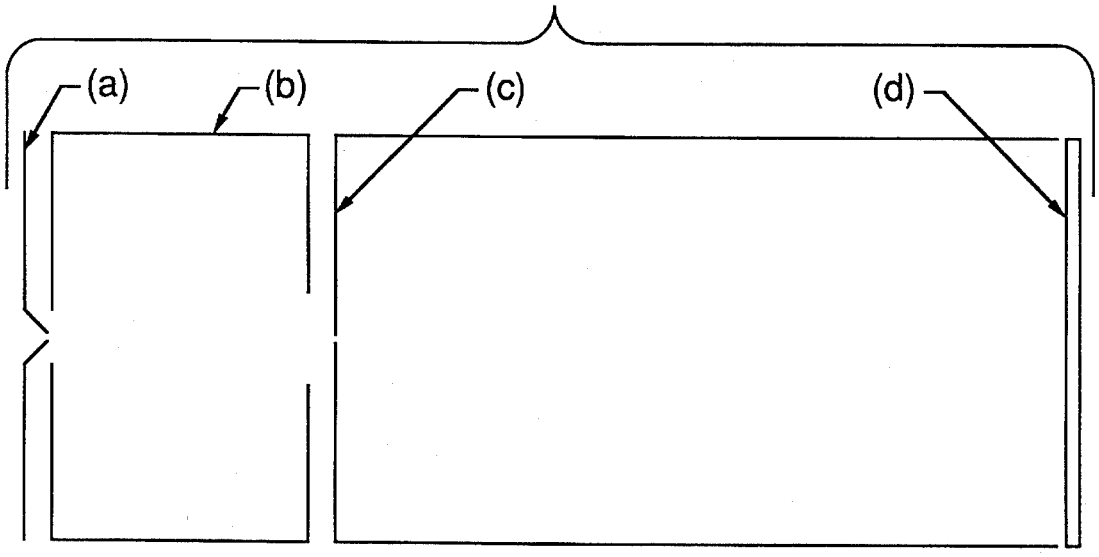
FIG. 2 is a plan view of the system of FIG. 1.

The present invention is a particular configuration of electrically grounded and biased structures. The configuration is illustrated in FIG. 1. The device consists of an aperture plate (a) in the shape of a wedge, with the actual aperture at the apex of the wedge, an analyzing structure (b) in the shape of a rectangular box with a hole in one end through which the aperture plate protrudes and a wide slit at the other end, an image plane (c) with a thin slit in it, and a particle detector (d). The preferable particle detector is a microchannel plate with a segmented anode, although a simple conducting plate (segmented or not) may be used connected to one or more analog current meters if the particle flux is large enough. The analyzing structure (b) serves as a means for spreading out the trajectories of charged particles into a trajectory pattern so that charged particles of interest are spatially spread out as they exit the slit in the electrically grounded image plane. More specifically, this structure is a boxed waveguide which has a charge supplied to its surface by a variable voltage source (e) which produces an electromagnetic field in the interior of the structure. Charged particles that encounter this electromagnetic field are diffracted in proportion to the charge they possess. By adjusting the location and size of the slit at the exit area of the analyzing structure, the user can selectively measure charged particles of interest. The user can also adjust the position of the detector to different locations in the trajectory pattern to detect only the charged particles of interest.

Figure 3:
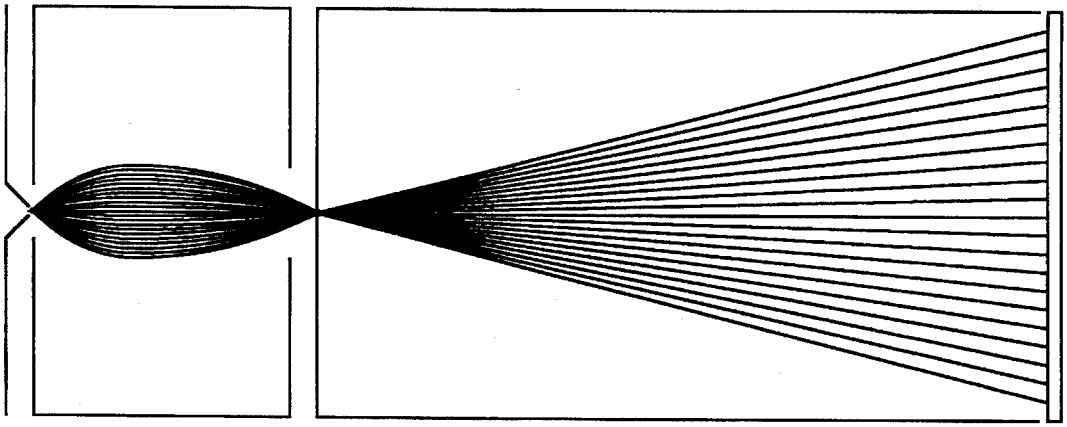
FIG. 3 is a chart of the particle trajectories within the retarding structure of FIG. 2.

In operation, the device is aligned to that the flux of particles to be analyzed enter the entrance aperture. The particle flux or current is measured as a varying voltage is applied to the analyzing structure. Particles with a given energy will have trajectories within the analyzing region as illustrated in FIG. 3, and will be focused on the slit in the image plane. Particles with different energies will be defocused and hence unable to pass through the slit and onto the active area of the particle detector. Because of the particular trajectory that the particles take, the position of the particle on the active are of the particle detector is uniquely related to the angle of incidence of the particle as it enters the device, as well as to the energy they possess.

The Spatial-focus energy analyzer can be made in a very compact package, limited only by machining tolerances. The device has inherently higher energy resolution that any comparable type of electrostatic analyzer.

Figure 4:
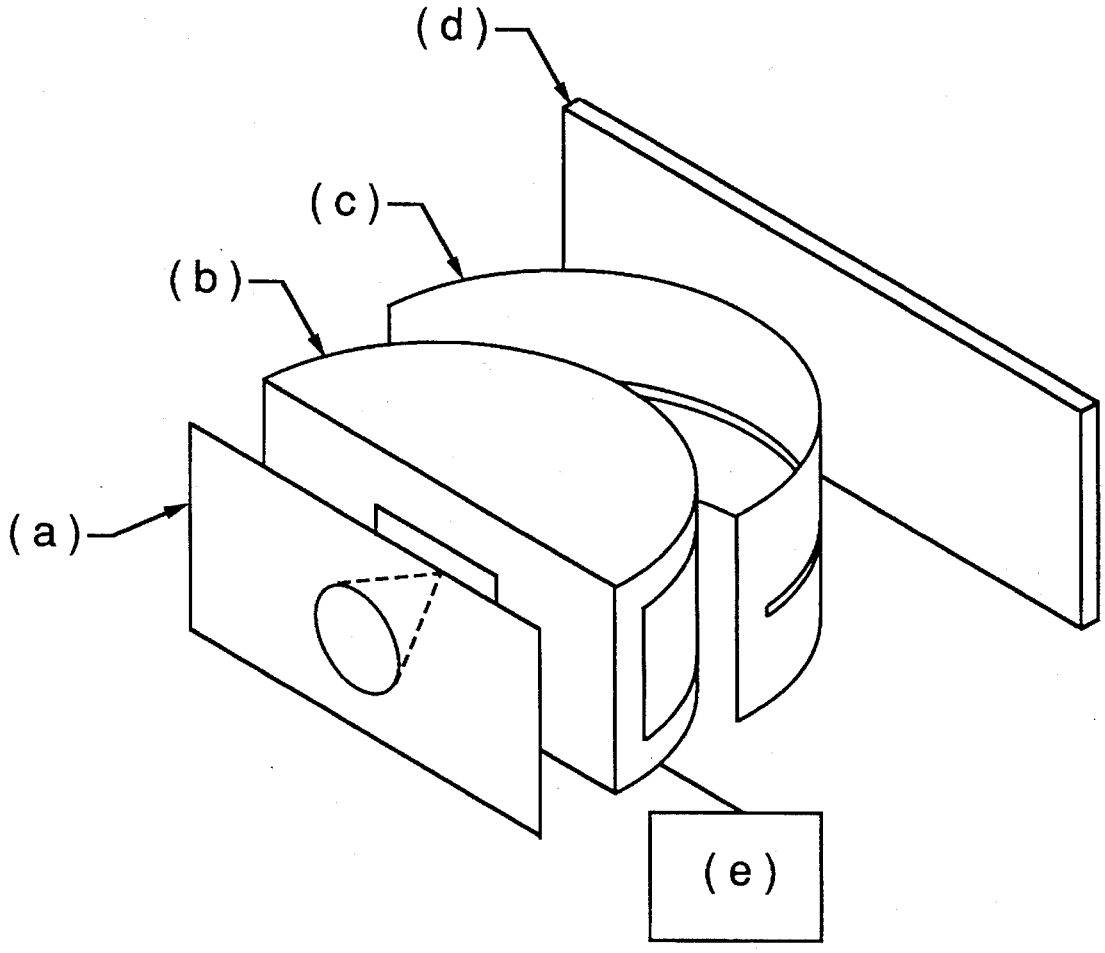
FIG. 4 is another embodiment of the invention.

The rectangular geometry of the device can be "wrapped" into a cylinder to increase the effective angular field of view. The placement and function of each of the components remains essentially unchanged. Such a variation is illustrated in FIG. 4.

This device is intended to determine the energies and directions of motion of a group of charged particles to a high degree of accuracy over a wide range of energies, and both embodiments present a type of electrostatic energy analyzer for charged particles (electrons and ions). It consists of an electrically grounded front aperture plate in the shape of a wedge with the entrance aperture at the apex of the wedge, an electrically biased analyzing structure in the shape of a box with a hole in one end through which the front aperture plate protrudes and a wide slit across the opposite end, an electrically grounded image plane with a thin slit in it, and a particle detector. The device determines the energies of incident charged particles by passing or rejecting particles as function of the bias potential applied to the analyzing structure.

This device may be used for any application where it is desirable to determine the energies of a group of charged particles. Principal applications include analysis of the charged particle environment in the vicinity of a spacecraft and control of plasma processing applications.

The present invention is a modified version of a copending application by the present inventor filed on Jul. 8, 1994, U.S. Ser. No. 08/275,697, the disclosure of which is incorporated herein by reference. The actual particle detector in both systems may be a particle detector selected from the group consisting of: channel election multipliers, microchannel plates, or a conducting plate structure which is electrically connected to a current meter. In both systems, the analyzing region is charged with an energy E by being electrically connected to a variable voltage source that produces a voltage V such that E qV where q is the electrical charge on a particle of interest. As the varying voltage is applied to the analyzing structure, particles with different charges will be directed along the different predetermined trajectories shown in FIG. 3. The position of the slit in the image plane can be adjusted by physically moving the image plane so that the particle detector will measure only the charged particles of interest.

While the invention has been described in its presently preferred embodiment it is understood that the words which been used are words of description rather than words of limitation and that changes within the purview of the appended claims may be made without departing from the scope and spirit of the invention in its broader aspects.

What is claimed is:

1. A spatial focus energy analyzer which measures the energy of charged particles, and which comprises:

an aperture plate containing an aperture through which said charged particles are passed, wherein said aperture plate comprises a wedge shaped structure having an apex which protrudes into said selecting means, and wherein the aperture of the aperture plate is located at said apex to pass said charged particles into said selecting means;

a means for measuring the energy of charged particles;

a means for spreading out trajectories of charged particles into a trajectory Dattern such that a particular particle's trajectory in said trajectory pattern is determined by the particular particle's energy; and a means for filtering out said groups of charged particles with said charges of interest in accordance with the particular particle's trajectory, said filtering means passing the groups of charged particles with the charges of interest from said spreading means onto said measuring means, wherein said filtering means comprises an image plane with a slit in its surface, said image plane having an adjustable position so that said slit may be positioned within said trajectory pattern so that the slit only passes the groups of charged particles with the energies of interest onto said measuring means.

2. A spatial focus energy analyzer, as defined in claim 1, wherein said spreading means comprises a rectangular structure which has a front and through which said charged particles enter from said aperture plate, said rectangular structure being electrically connected with a variable voltage source which charges said rectangular structure with an electric field which spreads said charged particles out into said trajectory pattern, said rectangular structure having an output part through which said charged particles pass towards said filtering means.

3. A spatial focus energy analyzer, as defined in claim 2, wherein said spreading means comprises a rectangular structure which has a front and through which said charged particles enter from said aperture plate, said rectangular structure being electrically connected with a variable voltage source which charges said rectangular structure with an electric field which spreads said charged particles out into said trajectory pattern, said rectangular structure having an output part through which said charged particles pass towards said filtering means.

4. A spatial focus energy analyzer, as defined in claim 1, wherein said spreading means comprises a rectangular structure which has a front and through which said charged particles enter from said aperture plate, said rectangular structure being electrically connected with a variable voltage source which charges said rectangular structure with an electric field which spreads said charged particles out into said trajectory pattern, said rectangular structure having an output part through which said charged particles pass towards said filtering means.

* * * * *